US005939207A

United States Patent [19]

Fensore et al.

[11] Patent Number: 5,939,207

[45] Date of Patent: Aug. 17, 1999

[54] THERMAL TRANSFER RIBBON FOR HIGH DENSITY/HIGH RESOLUTION BAR CODE APPLICATIONS

[75] Inventors: Alexander T. Fensore, Williamsville; Jeng-Li Liang, East Amherst; Thomas Rogers, Williamsville; Michael J. Wachowiak, Lancaster; Lan Jo Yeh, Williamsville, all of N.Y.

[73] Assignee: International Imaging Materials, Inc., Amherst, N.Y.

[21] Appl. No.: 08/866,321

[22] Filed: May 30, 1997

[51] Int. Cl.[6] ..... B41M 5/00

[52] U.S. Cl. ..... 428/500; 428/195; 428/207; 428/323; 428/480; 428/484; 428/488.4; 428/500; 428/522

[58] Field of Search ..... 428/195, 207, 428/480, 484, 488.1, 488.4, 913, 914, 323, 500, 522

[56] References Cited

U.S. PATENT DOCUMENTS 4,865,901 9/1989 Ohno et al. ..... 428/212

*Primary Examiner*—Bruce H. Hess
*Attorney, Agent, or Firm*—Kubovcik & Kubovcik

[57] ABSTRACT

A thermal transfer ribbon having a pigmented layer with a unique combination of melt viscosity, hardness and mechanical properties and an ultra-thin release layer between the pigmented layer and a substrate is provided. The thermal transfer ribbon includes a release layer having a thickness of 0.1 to 1.0 micron provided on one side of the substrate, the release layer being composed of an ethylene vinylacetate copolymer, α-olefin maleic anhydride copolymer and wax. A pigmented layer is provided on the release layer and is composed of a low structure carbon black, a polystyrene resin and a polyacrylate resin. A heat-resistant backcoat is preferably provided on the back side of the substrate.

24 Claims, 6 Drawing Sheets

Prior art 1 printed rotated bar code with 5.5 mil fine line.

Prior art 2 printed rotated bar code with 5.5 mil fine line.

Ink 28 printed rotated bar code with 5.5 mil fine line.

Ink 2 printed rotated bar code with 5.5 mil fine line.

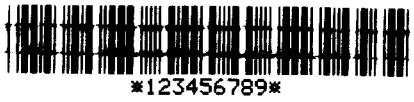
Prior Art 1
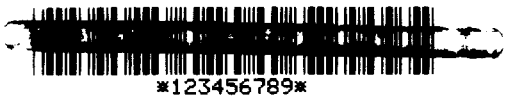
Prior Art 2
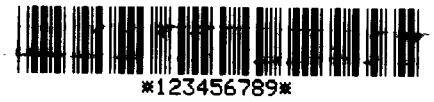
Ink 2
Figure 10: Scratch resistance comparison for prior arts 1, 2, and ink 2.

THERMAL TRANSFER RIBBON FOR HIGH DENSITY/HIGH RESOLUTION BAR CODE APPLICATIONS

BACKGROUND OF THE INVENTION

1. Field of the Invention

This invention relates to a thermal transfer ribbon for printing high density/high resolution bar codes for autoidentification.

2. Description of the Prior Art

Thermal transfer ribbons for printing black and colored images comprise a support substrate, ink-side coated layer (s) and a backcoat. Thermal transfer ribbons are used in tag and label applications to image various bar codes, human readable text and company logos. The printed tags and labels are usually comprised of low density/low resolution bar codes and images.

Recently, however, because of the availability of high resolution thermal print heads (200 to 400 dpi, i.e, heating elements per linear inch), end users of thermal transfer ribbons are now printing bar codes with an X dimension as small as 0.0025 inch. More complex logos are also being printed to take advantage of the availability of the higher resolution print heads.

An application where high density bar codes are being used is in the manufacturing of complex circuit boards. Common label sizes for circuit boards range from 5 mm to 15 mm in length. Despite the small size of such bar codes, they must be able to be identifiable.

Conventional thermal transfer ribbons do not image single isolated dots or fine line bar codes (lines with an X dimension of 1 dot) well. Conventional ribbons have heat-meltable ink layers composed primarily of wax or of both wax and resin. The wax-type thermal transfer ribbons can produce bar code images with sharp vertical lines, but the images have poor scratch resistance. The resin-type thermal transfer ribbons produce images with high scratch resistance, but poor fine line print quality.

In view of the foregoing, it is an object of the present invention to provide a thermal transfer ribbon that is capable of printing a highly scratch resistant, high density and high resolution bar code image.

SUMMARY OF THE INVENTION

The above object and other objects are achieved according to the present invention by a thermal transfer ribbon having a pigmented layer with a unique combination of melt viscosity, hardness and mechanical properties and an ultra-thin release layer.

More particularly, the present invention is a thermal transfer ribbon comprising a support substrate; a release layer having a thickness of 0.1 to 1.0 micron provided on one side of the substrate and being composed of an ethylene vinylacetate copolymer, an α-olefin maleic anhydride copolymer and wax; a pigmented layer provided on the release layer and composed of a low structure carbon black, a polystyrene resin and a polyacrylate resin; and a heat-resistant backcoat provided on the other side of the substrate.

The thermal transfer ribbon of the present invention is capable of printing 3 to 10 mil vertical high resolution bar codes with an absence of line breakage and is capable of printing sharper 10 mil (1 mil=0.001 inches) horizontal bar codes. The printed images have excellent scratch durability.

BRIEF DESCRIPTION OF DRAWINGS

FIG. 10 shows a comparison of scratch resistance of bar codes printed using prior art thermal transfer ribbons (prior art 1 and 2) and using a thermal transfer ribbon according to the present invention.

DESCRIPTION OF PREFERRED EMBODIMENTS

Figure 1:
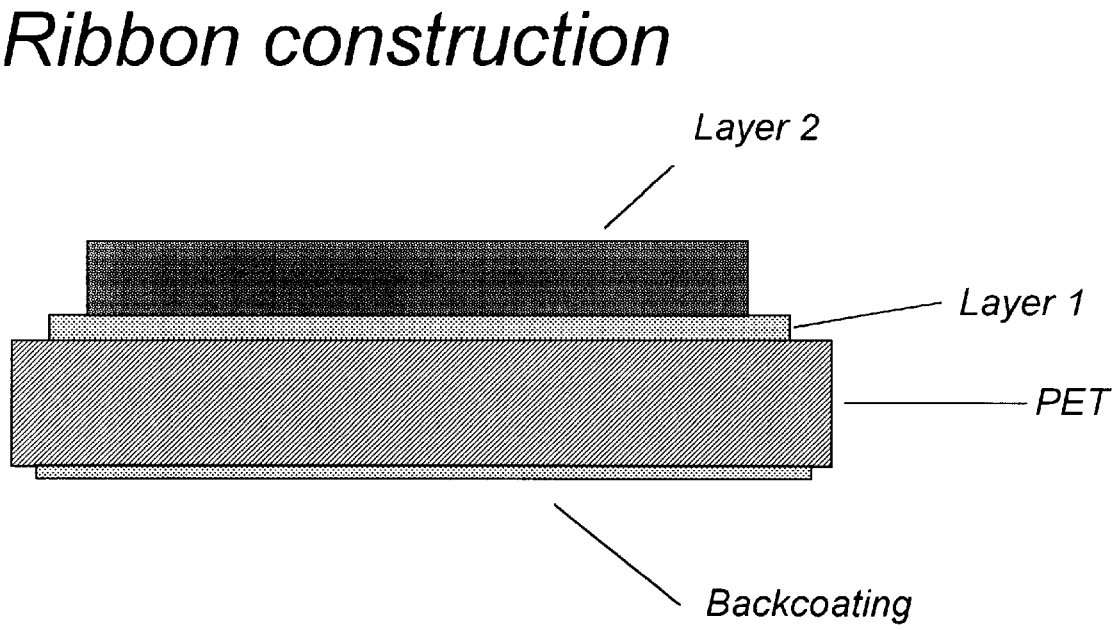
FIG. 1 is a cross-section of a thermal transfer ribbon according to the present invention.

The thermal transfer ribbon of the present invention comprises a support substrate (hereinafter referred to simply as a "substrate"), a heat-resistant backcoat provided on one side, or surface, of the substrate and a face coating on the other side, or surface, of the substrate.

The substrate can be selected from a variety of materials provided that the materials are thermally and dimensionally stable. The substrate can be, for example, polyester film, polystyrene film, polysulfone film, polyvinyl alcohol film, polyimide film or other material known in the art for use as the support substrate of a thermal transfer sheet. The preferred substrate, from the standpoints of cost and heat resistance, is polyethylene terephthalate (PET). The thickness of the substrate can range from 2 to 30 μm. The preferred thickness when the substrate is PET is 3 to 7 μm. More preferably, the thickness is less than 6 μm.

The heat-resistant backcoat is provided on the side of the thermal transfer ribbon that contacts the print head during printing and provides good thermal and slip properties. During printing the heating elements of the print head provide pulses of heat of very short duration to cause transfer of the face coat to a receiver. The heating elements can reach temperatures as high as 350° C. The heat-resistant backcoat protects the substrate from these high temperatures and prevents melting or sticking of the substrate to the print head.

The backcoat contains a heat-resistant binder and one or more slip agents. The composition of the backcoat is not particularly limited as long as it provides sufficient heat resistance to protect the substrate and prevent sticking and provides good slip characteristics. A typical backcoat comprises the reaction product of a hydroxy group-containing silicone urethane polymer and an isocyanate crosslinking agent.

The backcoat has a thickness of about 0.1 to 0.5 μm and can be applied to the substrate by several methods. The materials can be melted and blended under heat and applied to the film in the melted state. Preferably, the materials are dissolved in an organic solvent or solvent mixture, applied to the substrate, and the solvent evaporated. In either case, the backcoat can be applied by any standard printing or coating technique. Examples of application methods include: direct and indirect gravure, gravure reverse coating, roll coating, and flow tube and Mayer rod coating.

The face coat of the thermal transfer ribbon according to the present invention consists of two ink layers having optimal melt viscosities, hardness and mechanical properties. The two ink layers are an ultra-thin release layer that directly contacts the surface of the substrate opposite the surface having the backcoat and a top, pigmented layer. The components of the face coat are chosen so as to provide the following preferred ranges of melt viscosity (at 109° C.), elongation (at 32° C.) and break strength (at 32° C.) of said top, pigmented layer:

a) Melt Viscosity: Desired range=100 to 3000 cP More desired range=100 to 600 cP b) Elongation: Desired range=100 to 400 μm More desired range=100 to 280 μm c) Break Strength: Desired range=20 to 70 psi More desired range=40 to 70 psi The release layer has a thickness of 0.1 to 1.0 μm and contains an ethylene vinylacetate (EVA) copolymer, an α-olefin maleic anhydride copolymer and wax.

The amount of each of the EVA copolymer and α-olefin maleic anhydride copolymer in the release layer is 5 to 15% by weight in terms of solids in the solid ink (release) layer. If the amount of each of these copolymers is less than about 5% by weight, the pigmented ink layer will not adhere well to the substrate and will flake. If the amount of each of these copolymers is greater than about 15%, the ink will not completely transfer to a receiver during printing. The preferred amount of the EVA copolymer in the release layer is 11 to 13% by weight. The preferred amount of the α-olefin maleic anhydride copolymer in the release layer is 10 to 13% by weight.

The EVA copolymer useful in the release layer contains between about 15 and 40% by weight and, preferably, 15 and 35% by weight of vinyl acetate units. A lower percentage of vinyl acetate in the copolymer will lower the melt viscosity of the release layer composition. Examples of EVA copolymers useful as a component of the release layer of the thermal transfer ribbon of the present invention and the properties of the copolymers that influence ink performance are listed in Table 1. Evaflex 577 is particularly preferred.

TABLE 1

Ethylene vinylacetate copolymer properties

| Ingredient | % Vinylacetate | Softening Point (° C.) | Melt Index (dg/minute) |
|---|---|---|---|
| Elvax 40W[1] | 40 | 104 | 56 |
| Elvax 140W | 33 | 74 | 400 |
| Elvax 150 | 33 | 110 | 43 |
| Elvax 205W | 28 | 80 | 800 |
| Elvax 210W | 28 | 82 | 400 |
| Elvax 220W | 28 | 88 | 150 |

TABLE 1-continued

Ethylene vinylacetate copolymer properties

| Ingredient | % Vinylacetate | Softening Point (° C.) | Melt Index (dg/minute) |
|---|---|---|---|
| Elvax 310 | 25 | 88 | 400 |
| Elvax 410 | 18 | 88 | 500 |
| Evaflex 577[2] | 19 | Melts at 72 | >2000 |

[1,2]Elvax and Evaflex are products of E. I. duPont de Nemours and Co., Inc.

The α-olefin of the α-olefin maleic anhydride copolymer useful as a component of the release layer has a chain length of $C_1$ to $C_{50}$ and, preferably, $C_{20}$ to $C_{50}$. The preferred olefin:anhydride ratio is 1:1 to 1:4 in terms of weight. Examples of suitable α-olefin maleic anhydride copolymers for use in the present invention and the properties of the copolymers that influence ink performance are listed in Table 2. Ceramer 67 is particularly preferred.

TABLE 2

α-olefin maleic anhydride copolymer properties

| Ingredient | Olefin Chain Length | $M_w$ | Melting Point (° C.) |
|---|---|---|---|
| Diacarna 30B[1] | $C_{30}$ to $C_{50}$ | **** | 69 |
| Petrolite Q-0048[2] | $C_{14}$ | 9287 | 142 |
| Petrolite X-8034 | $C_{18}$ to $C_{28}$ | 5000 | 35 |
| Petrolite X-8039 | $C_{30}$ | 6909 | 65 |
| Petrolite X-8040 | $C_{24}$ to $C_{28}$ | 6588 | 73 |
| Petrolite X-8043 | $C_8$ | 3200 | 111 |
| Petrolite X-8044 | $C_{10}$ | 5000 | 108 (softening point) |
| Petrolite X-8047 | $C_{20}$ | 5000 | 46 |
| Petrolite X-8023 | $C_{20}$ to $C_{30}$ | 5000 | 35 |
| Ceramer 67[3] | $C_{50}$ | 721 | 97 |
| Ceramer 1608 | $C_{30+}$ | 3096 | 77 |

[1]Dicarna is a product of Mitsubishi Kasei
[2]Petrolite and Ceramer are products of Petrolite Polymers Division The wax provides appropriate release properties to the release layer. The wax should have a softening point of between about 70° and 120° C. Suitable waxes are believed to include microcrystalline wax, carnauba wax, Petronaba wax (synthetic carnauba wax), paraffin wax, candelilla wax, low molecular weight polyethylenes, Suncrowax HGLC (a synthetic wax), Kester #2 and Montan wax. Carnauba wax is preferred because it provides good line sharpness and durability. To impart optimal release properties to the release layer the amount of wax in the layer should be in the range of 70 and 84 solid % and, preferably, 75 and 80 solid %.

The thickness of release layer is between 0.1 and 1 μm. When the thickness of the release layer is greater than about 1.0 μm, the printed image has reduced durability. When the thickness is less than about 0.1 μm, ink transfer may be adversely affected. The release layer can be formed on the substrate by a conventional hot-melt or solvent coating method.

The second, i.e., top, layer of the face coat is a pigmented layer containing low structure carbon black, wax, a polystyrene resin and a polyacrylate resin. The top layer can range in thickness from about 1 to about 3 μm. A thickness greater than about 3 μm can cause flaking and reduced durability. The combination of polystyrene, polyacrylate resin and low structure carbon black can provide an ink with a low melt viscosity (e.g., 296 cP at 110° C. and a shear rate of 2155 $sec^{-1}$), low tensile elongation and tensile strength (e.g., 276 $\mu$m and 63.5 psi, respectively, at 32° C. and a crosshead speed of 0.1 inch/minute) and high ink hardness (e.g., penetration=0.35% at 400° C.).

The carbon black of the top layer is a "low structure" carbon black having a dibutyl phthalate absorption value of 40 to 400 ml/100 g; preferably, 40 to 50 ml/100 g and, most preferably, 48 ml/100 g. A carbon black having a low oil absorption value reduces the melt viscosity of the ink. The particle size of the carbon black is preferably within the range of about 30 to 60 nm. This range of particle size provides a top layer having acceptable melt viscosity and darkness. The amount of pigment in the top ink layer should be between about 17 and 20% by weight. Carbon blacks that have been determined to produce good results in the thermal transfer ribbon of the present invention are listed in Table 3. All of the carbon blacks listed in Table 3 are the products of Degussa. Degussa Special Black 250 is preferred.

TABLE 3

Carbon black properties

| Carbon Black | Particle Size (nm) | DPB Oil Absorption (ml/100 g) | pH Value |
|---|---|---|---|
| Printex 140U | 29 | 380 | 4 |
| Special Black 250 | 56 | 48 | 3 |
| Special Black 350 | 31 | 50 | 3 |
| Special Black 550 | 25 | 49 | 4 |
| Printex 25 | 56 | 46 | 9.5 |
| Printex 45 | 26 | 52 | 10 |
| Printex 55 | 25 | 48 | 10 |
| Printex 75 | 17 | 47 | 9.5 |
| Printex 85 | 16 | 48 | 9.5 |
| Printex 95 | 15 | 52 | 9.5 |

The polystyrene resins that can be used as a component of the top ink layer are those having a Tg of from 40 to 110° C. and a $M_W$ of 1000 to 15000 g/mole. These ranges provide optimum melt viscosity and tensile properties of the ink layer. The preferred ranges of Tg and $M_W$ are 40 to 70° C. and 1000 to 2000 g/mole, respectively. The solid percentage of the polystyrene in the solid ink should be about 23 to 28%.

The polystyrene resins having the required Tg and $M_W$ are typically polystyrene copolymers and, more typically, copolymers of α-methylstyrene and either styrene or vinyl toluene. Polystyrene resins that have been determined to provide desired melt viscosity and tensile properties are listed in Table 4. Piccotex LC is preferred. All of the polystyrene resins listed in Table 4 are products of Hercules.

TABLE 4

Polystyrene properties

| Polystyrene Resin | Composition | $T_g$ (° C.) | $M_w$ | Softening Point (° C.) |
|---|---|---|---|---|
| Kristalex 31001 | Styrene, α-methyl styrene | 46 | 1600 | 100 |
| Kristalex 3115 | Styrene, α-methyl styrene | 64 | 2500 | 115 |
| Piccotex 75 | Vinyl toluene, α-methyl styrene | 29 | 1100 | 75 |
| Piccotex 100 | Vinyl toluene α-methyl styrene | 42 | 2650 | 98 |
| Piccotex 120 | Vinyl toluene, α-methyl styrene | 68 | 3800 | 118 |
| Piccotex LC | Vinyl toluene, α-methyl styrene | 43 | 1500 | 90 |
| Endex 155 | Styrene, α-methyl styrene | 100 | 8600 | 152 |
| Endex 160 | Styrene, α-methyl styrene | 105 | 11150 | 160 |

The polyacrylate resin of the top, pigmented ink layer has a Tg within the range of 40 to 110° C. and a $M_W$ within the range of about 7000 to $30\times10^4$ g/mole. The preferred Tg and $M_W$ are 40 to 60° C. and 10000 to 50000 g/mole, respectively. These properties are chosen to provide optimum ink melt viscosity, tensile properties and hardness. The solid percentage of the polyacrylate resin in the ink should be about 10 to 13%.

Polyacrylate resins having the Tg and $M_W$ required to obtain optimum ink properties are typically polymers and copolymers of methacrylates, methacrylic acids and acrylamides. The preferred polyacrylate resin is a terpolymer of methylmethacrylate, methacrylic acid and n-butyl methacrylate having a range of MMA in terms of mole percent of 30 to 80%. Polyacrylate resins that have been determined to be particularly useful in the present invention and their properties are listed in Table 5. Dianal MB-2543 is a preferred polyacrylate resin.

TABLE 5

Polyacrylate resins and their properties

| Polyacrylate Resin | Composition | Tg (° C.) | $M_w$ |
|---|---|---|---|
| BR-71 | MMA | 55 | 60000 |
| BR-80 | MMA | 105 | 95000 |
| BR-85 | MMA | 105 | 280000 |
| BR-106 | MMA/nBMA/MAA | 50 | 60000 |
| BR-107 | MMA/nBMA/MAA | 50 | 60000 |
| MB-2543 | MMA/nBMA/MAA | 50 | 35000 |
| MB-2594 | MA/IBMA/ BMA/AA | 80 | 7000 |
| MB-2595 | MA/IBMA/ BMA/AA | 80 | 7000 |
| MB2616 | MMA/nBMA/MAA | 50 | 20000 |
| QR-1381[1] | MMA/BMA | 105 | 100000 |

MMA = Methylmethacrylate,
nBMA = n-Butylmethacrylate,
MAA = Methacrylic acid,
IBMA = Isobutylmethacrylate,
BMA = Isobornylmethacrylate,
AA = Acrylamide,
MA = Methylacrylate
[1]QR-1381 is a product of Rohm and Haas. All others are products of Dianal America.

In preparing the face coat of the thermal transfer ribbon of the present invention, the release layer is first applied to the base ribbon typically as a solution by conventional methods and apparatus well known to those of ordinary skill in the art. The solvent is then removed, typically by evaporation.

The top, pigmented layer is then typically applied to the release layer as a solution also by conventional methods and apparatus well known to those of ordinary skill in the art. The solvent is then removed, typically by evaporation.

FIG. 1 illustrates the construction of the thermal transfer ribbon according to the present invention. Layer 2 is the top ink layer described above and which contains low structure carbon black and polystyrene and polyacrylate resins having the ranges of Tg and $M_W$ required to provide optimum ink melt viscosity, tensile properties and hardness.

Layer 1 is the release layer described above and which is composed of the specified ethylene vinylacetate copolymer, α-olefin maleic anhydride copolymer and wax in the specified amounts.

Tables 6 and 7 show preferred formulations for layer 2 and layer 1. These formulations were determined using a systematic design approach and method as described below.

TABLE 6

Ink formula for layer 2

| Material | Chemical Names | % in Dry Ink |
|---|---|---|
| Carnauba Wax IP | Carnauba Wax | 34–42 |
| PEG 400 Monostearate | Polyethylene Glycol compound | 0.72–0.88 |
| Piccotex LC | Polystyrene Resin | 23–28 |
| Dianal 2543 | Polyacrylate Resin | 10–13 |
| Special Black 250 | Carbon Black | 17–20 |
| Dioctyl Phthalate | Dioctyl Phthalate | 3–4 |
| Homogenol L-18 | Polycarboxylic Acid | 4–5 |

TABLE 7

Ink formula for layer 1

| Material Name | Chemical Name | % in Dry Ink |
|---|---|---|
| Carnauba Wax IP | Carnauba Wax | 75–84 |
| Ceramer 67 | α-Olefin Maleic Anhydride Copolymer | 10–13 |
| Evaflex 577 | Ethylene Vinyl Acetate Copolymer | 11–13 |

A. Vertical Bar Codes

Figure 2:
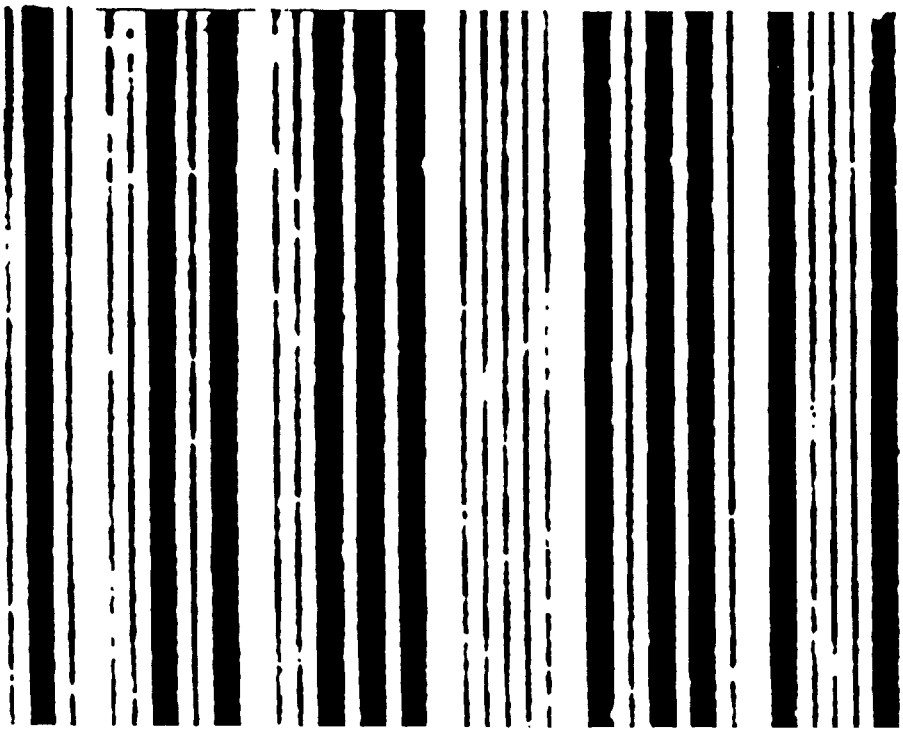
FIG. 2 shows a printed normal bar code with a finest line of 3.3 mil printed using a first prior art thermal transfer ribbon (prior art 1).
Figure 3:
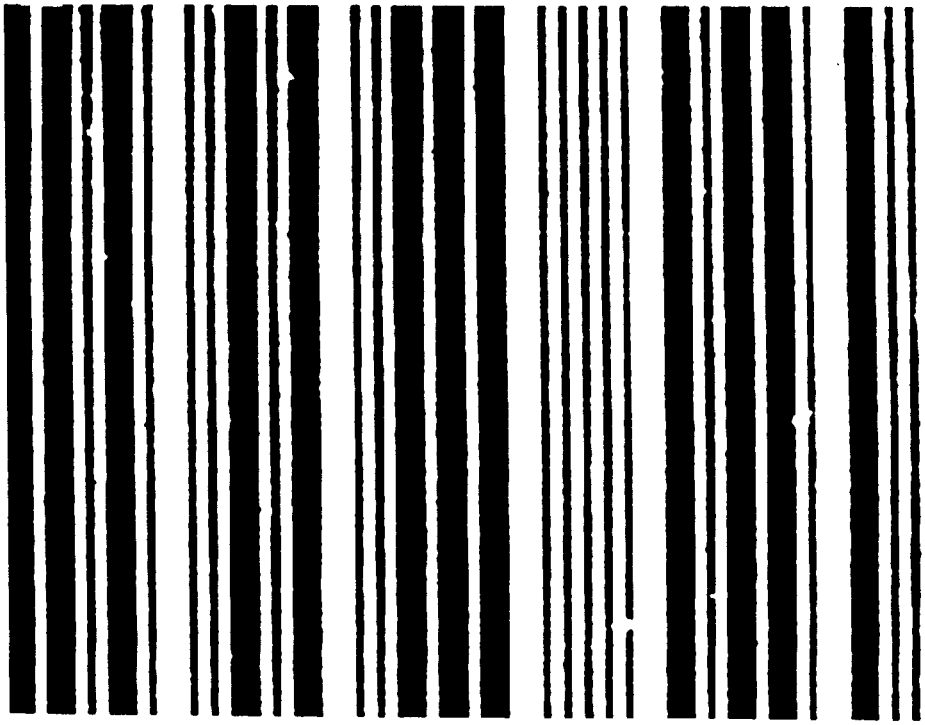
FIG. 3 shows a printed normal bar code with a finest line of 3.3 mil printed using a second prior art thermal transfer ribbon (prior art 2).
Figure 4:
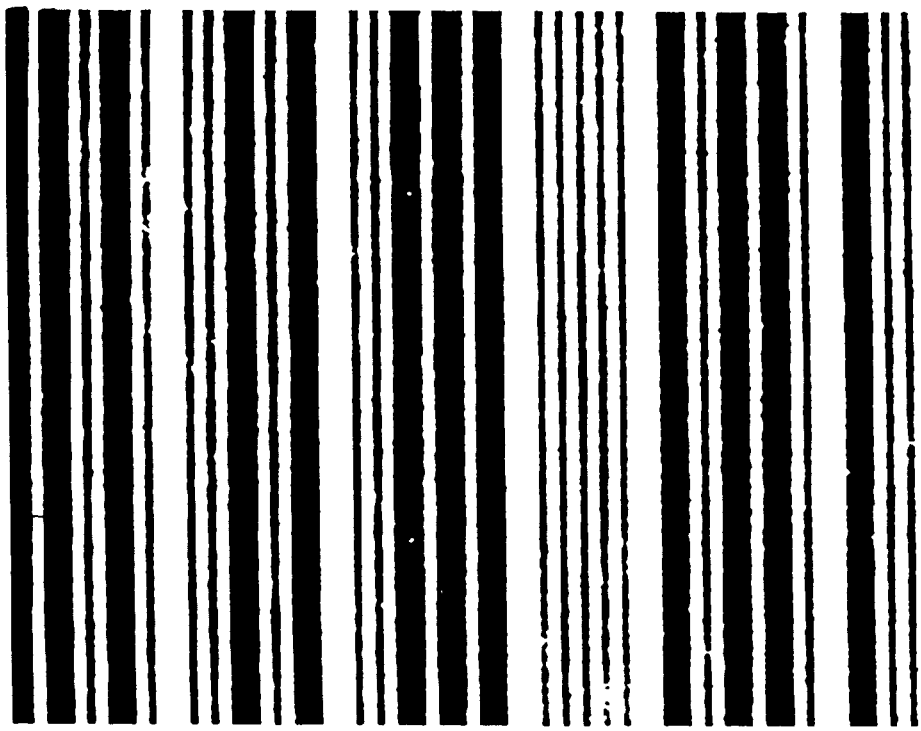
FIG. 4 shows a printed normal bar code with a finest line of 3.3 mil with a thermal transfer ribbon including only the top ink layer of the two-layered face coat of the present invention.
Figure 5:
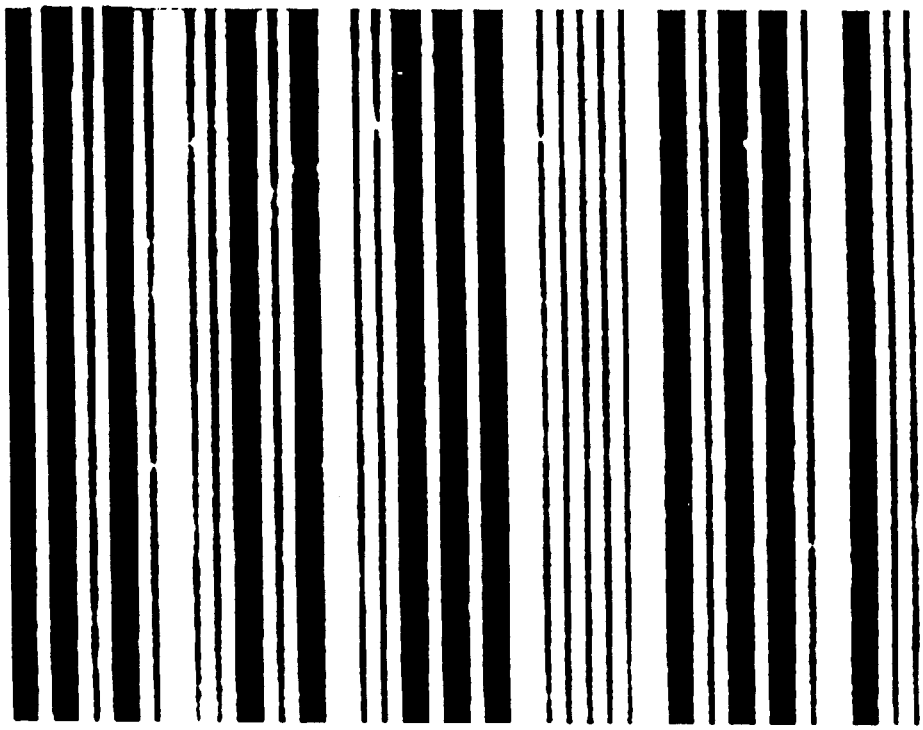
FIG. 5 shows a printed normal bar code with a finest line of 3.3 mil printed with a thermal transfer ribbon according to the present invention.

FIGS. 2 through 5 illustrate a comparison of the vertical fine line print quality of print samples generated using the ribbon construction described in this invention with print samples generated using prior art. FIGS. 2 and 3 show print samples generated using prior art 1 and prior art 2. Prior art 1 is a wax/resin ribbon which has a high scratch resistance, but prints vertical bar codes with poor line integrity. Prior art 2 is an all wax ribbon which prints vertical bar codes with high line integrity, but has very low durability. FIG. 4 is a print sample generated using a PET film coated only with layer 2 described in Table 6. FIG. 5 is a print sample generated using a PET film coated with layers 1 and 2 described in Table 6. The ribbon configuration of each of FIGS. 4 and 5 can produce high resolution 3 to 10 mil vertical bar codes without any line breakage. These ribbon configurations also have high scratch resistance.

The line sharpness and the number of breaks in the fine lines were improved by reducing the melt viscosity of layer 2 compared to the melt viscosity used in the prior art. Reducing the melt viscosity of the ink increases its fluidity and permits more ink to penetrate into the pores of the receiver during the printing process. This improves the adhesion of the ink to the receiver and reduces the number of line breaks caused by ink not completely transferring to the receiver.

Table 8 shows the effect of the polystyrene, polyacrylate resin, and carbon black on the melt viscosity of the ink described in this invention relative to the prior art. The dibutyl phthalate (DBP) absorption values listed in Table 8 reflect the structure of the carbon black.

As shown in Table 8, the ink Prior Art A has a melt viscosity of 2700 cP and a correspondingly poor fine line print quality. Ink A represents an ink that used the same pigment that was used in the Prior Art, but Ink A used a different vehicle system containing a polystyrene resin and a methylmethacrylate resin. This change resulted in a melt viscosity of 585 cP. Ink A showed reduced line breakage and improved image sharpness compared to the prior art when used to print high resolution bar codes. A lower structure carbon black was used in Ink B-S in conjunction with the same vehicle system that was used in ink A. The lower structure carbon black reduced the melt viscosity to a value of 296 cP, and excellent high resolution bar code print quality was observed.

TABLE 8

Fine line printing improvement due to low melt viscosity. Fine line quality was graded on a visual scale from 1 to 5. 5 = excellent and 1 = poor

| Ink | Carbon Black DBP absorption (ml/100 g) | Contains Polystyrene and Methacrylate | Melt Viscosity (cP) | Fine Line Quality (3.3 mil line) |
|---|---|---|---|---|
| Prior Art A | 115 | no | 2700 | 2 |
| A | 115 | yes | 585 | 3 |
| B-S | 48 | yes | 296 | 5 |

B. Horizontal (Rotated) Bar Codes

Excess ink transfer (trailing edge) in rotated bar codes can cause scanning failure from a verifier. Due to low tensile elongation and cohesive strength, brittle inks produce sharper rotated bar codes. The sharp rotated bar code is a result of a clean ink cleavage that occurs when the ribbon strips away from the receiver. In contrast, a ductile ink tends to have a higher tensile elongation and is tougher to break. Ink filamentation also occurs when a ductile ink cleaves at the ribbon stripping point.

Figure 6:
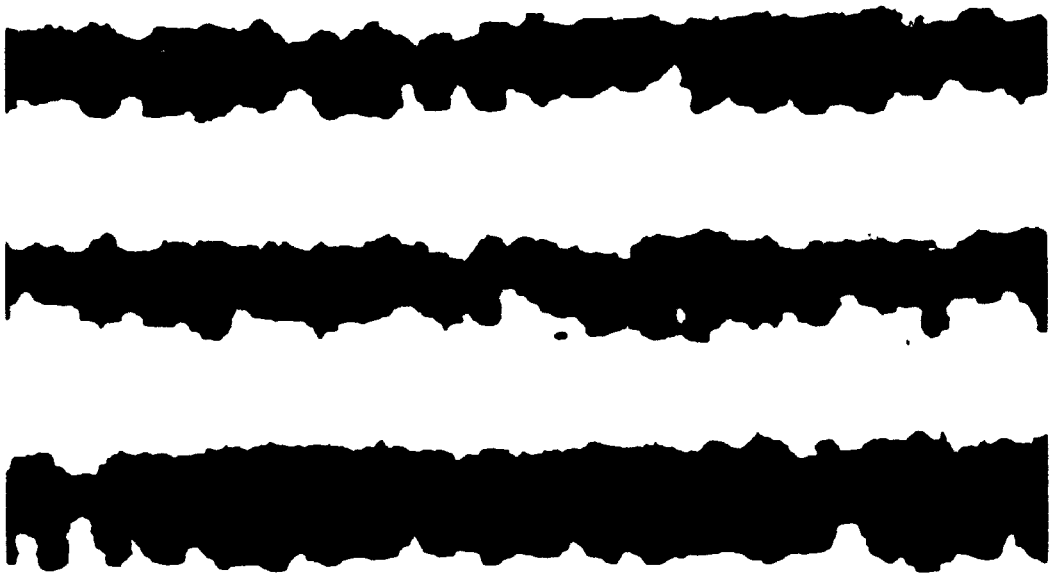
FIG. 6 shows a printed rotated bar code with 5.5 mil fine line printed using the first prior art thermal transfer ribbon (prior art 1).
Figure 7:
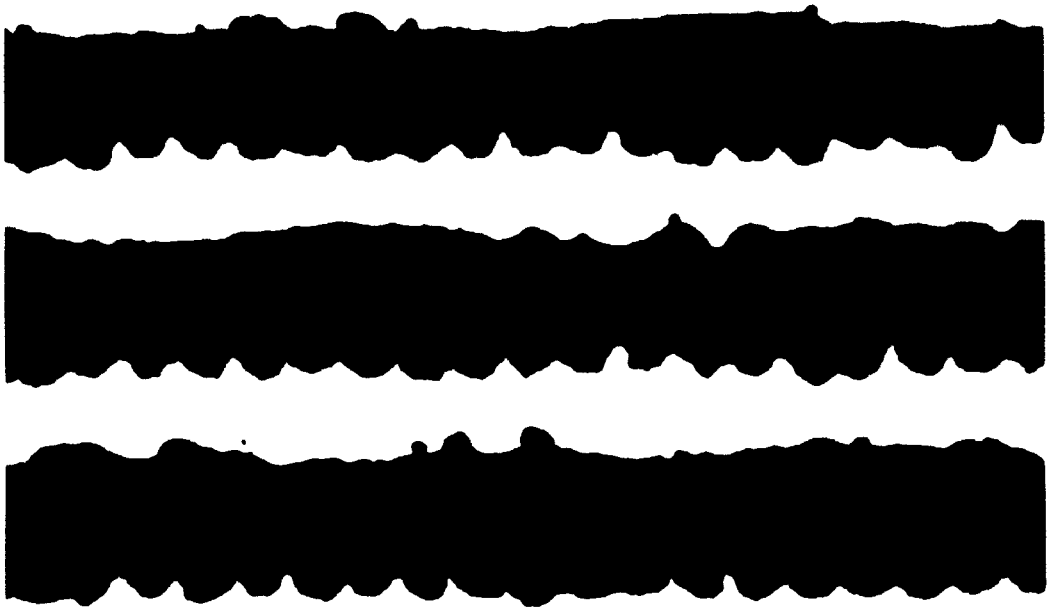
FIG. 7 shows a printed rotated bar code with 5.5 mil fine line printed using the second prior art thermal transfer ribbon (prior art 2).
Figure 8:
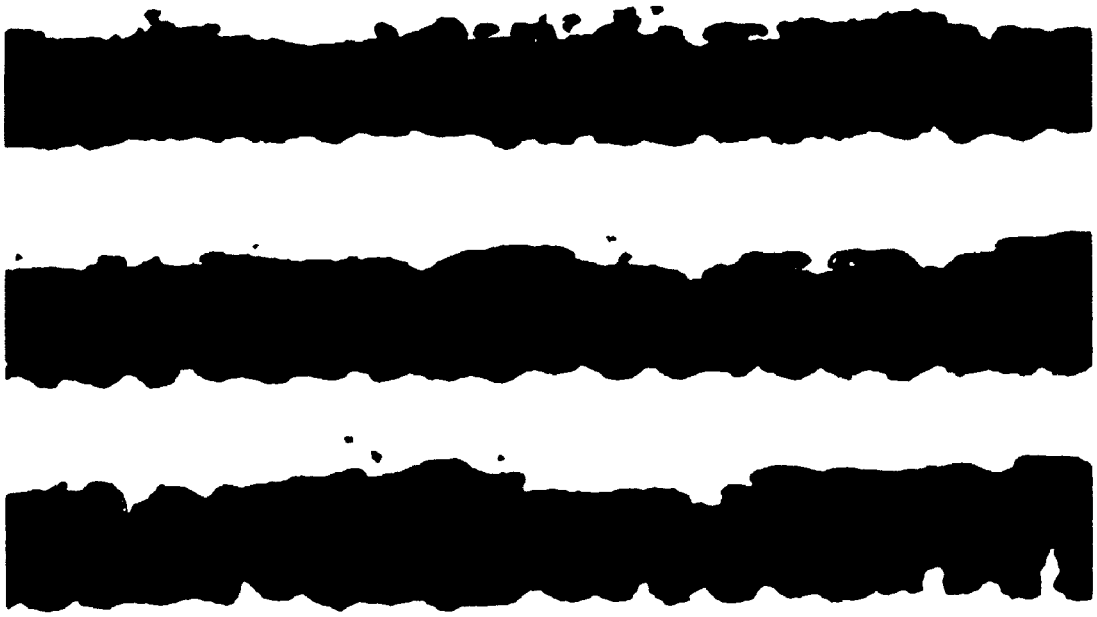
FIG. 8 shows a printed rotated bar code with 5.5 mil fine line printed with a thermal transfer ribbon including only the top ink layer of the two-layered face coat of the present invention.

Two approaches were used to eliminate trailing edge in rotated bar codes. The first method is to make the ink more brittle and lower its tensile strength and elongation. Table 9 shows that the incorporation of high Tg Piccotex (α-methyl polystyrene/vinyl toluene) tackifier lowers the ink's tensile strength and elongation. In addition to the substitution of high Tg Piccotex, a high Tg polyacrylate can reduce the tensile strength and elongation even further. FIGS. 6 through 8 show that the trailing edge of print samples generated using only layer 2 listed in Table 6 is improved in comparison to that of prior art. Prior art gives either a broad line or does not transfer the ink completely.

Figure 9:
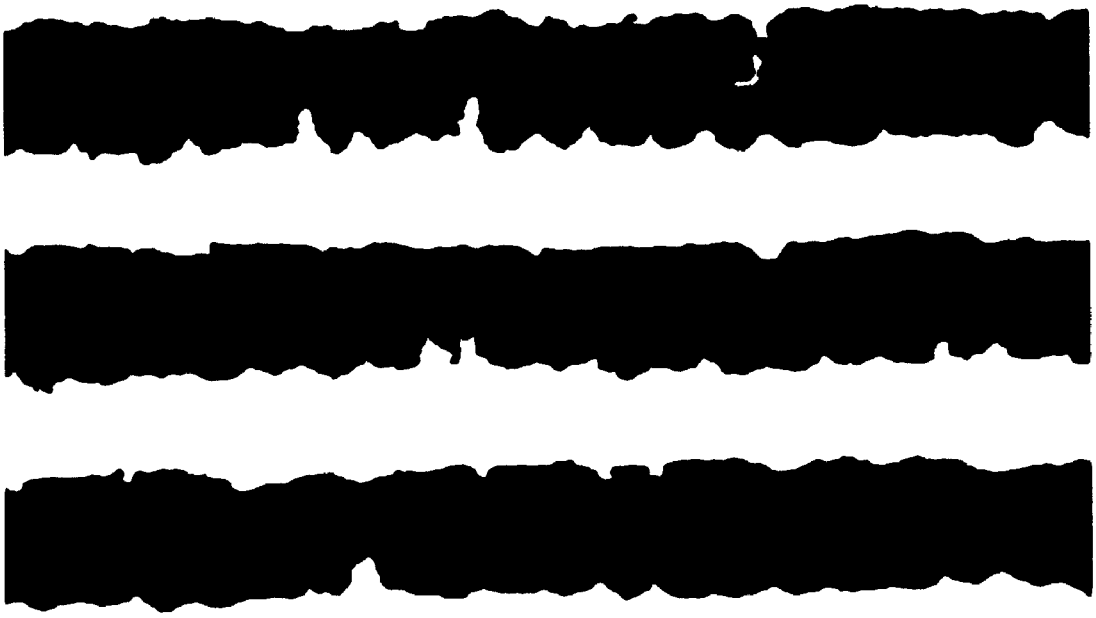
FIG. 9 shows a printed rotated bar code with 5.5 mil fine line printed with a thermal transfer ribbon according to the present invention.

A second approach is to incorporate an undercoat (release layer) with the formulation listed in Table 7. This undercoat not only improves scratch durability, but also improves trailing edge. FIG. 9 shows that the line sharpness of the rotated bar code is improved and better than the prior art.

TABLE 9

Mechanical properties of top coat inks

| Formulation | Polystyrene $M_w$ | Polystyrene Tg | Polyacrylate $M_w$ | Polyacrylate Tg | Polyacrylate solid % | Break strength at 32° C. psi | Elongation micrometer | Trailing Edge 6 ips, 9.9 mil energy + 10 |
|---|---|---|---|---|---|---|---|---|
| INK C | 1100 | 29 | 35000 | 50 | 11.2 | 41.6 | 308.1 | 2 |
| INK B-S | 1500 | 43 | 35000 | 50 | 11.2 | 63.51 | 276 | 3 |
| INK D | 3800 | 68 | 35000 | 50 | 11.2 | 46.3 | 109.5 | 3 |
| INK E | 1500 | 43 | 15000 | 100 | 6 | 32 | 101.1 | 3 |

C. Durability

High ink hardness provides excellent scratch durability. Table 10 shows that ink will have a scratch resistance of 5 (the best) if the ink penetration is less than 0.35%. High Tg polystyrene resins such as the ones used in inks B and D have better scratch durability due to low ink penetration. In contrast, Ink C utilizes a polystyrene resin with a Tg of 29° C. and has a scratch resistance of only 3. The molecular weight and chemistry of the polyacrylate resin will also affect the ink penetration and scratch resistance. High molecular weight polyacrylate used in ink F produces better scratch resistance than the polyacrylate used in ink E. Ink B-S uses a methacrylate terpolymer that is more sterically hindered due to the methyl group on the backbone. Ink F uses a methacrylate/acrylate terpolymer in which the acrylate portion does not have a methyl group on the side chain which reduces the steric hindrance in this terpolymer. The added steric hindrance in the methacrylate terpolymer used in ink B-S makes the methacrylate more rigid and this will make the ink harder increasing scratch resistance. This is why ink B-S gives excellent durability even though the $M_W$ of the methacrylate terpolymer in ink B-S is lower than the acrylate containing terpolymer used in ink F. Overall ink B not only retains a level of 5 in scratch durability, it also gives a level of 5 in fine line printing. FIG. 10 shows this formulation has a scratch resistance equal to that of prior art.

A disc-shape sample (10 mm diameter and 2 mm thickness) is formed by solidifying the ink from a heated aluminum mold. This sample is then placed into a test chamber of Perkin-Elmer TMA7. Isothermal penetration tests are performed at 40° C. and under a load of 100 miliNewton. The degree of penetration reflects ink hardness.

3. Tensile strength and elongation

A rectangular specimen (10 mm width×50 mm length×1 mm thickness) is formed by solidifying the ink from a heated aluminum mold. The tensile strength and elongation at break are measured using a SinTech tensile tester. The sample is tested at 32° C. and with a cross head speed of 0.1 in/min.

E. Thermal Transfer Print Quality Testing

A thermal transfer label printer with a printhead resolution of 300 dpi was used to produce print samples on various receivers. Testing includes fine line (1 X dimension bars) printability, normal bar codes, rotated bar code quality (trailing edge defect), voiding, and image durability.

1. Fine Line Print Testing

Fine line printing, also known as line integrity, is the ability of a printing system to image lines at X dimensions of 1 dot. For our testing a Code 39, 3.3 mil bar code printed in the normal orientation was used. Burn energies on the printer were adjusted until bar breakage in the 3.3 mil bars were minimized. This was done by using a 10X loupe and paying close attention, so that the bars were not beginning to bloom, thus masking the evaluation. Two consecutive labels were imaged with the first label being discarded to avoid any printer startup defects. When the burn energy was optimized each sample was graded using the 10X loupe on a scale of 0–5, with 0 being the worst.

2. Print Quality of Normal Bar Codes

TABLE 10

Ink hardness

| Formulation | Piccotex $M_w$ | Piccotex Tg | Acrylate $M_w$ | Acrylate Tg | Acrylate Solid % | Ink penetration 40C, 50 mins | Scratch Durability 250 cycles |
|---|---|---|---|---|---|---|---|
| INK C | 1100 | 29 | 35000 | 50 | 11.2 | 1.20% | 3 |
| INK B-S | 1500 | 43 | 35000 | 50 | 11.2 | 0.35% | 5 |
| INK D | 3800 | 68 | 35000 | 50 | 11.2 | 0.01% | 5 |
| INK E | 1500 | 43 | 70K/25K | 35,105 | 12%,50/50 | 0.74% | 4 |
| INK F | 1500 | 43 | 70K/40K | 35,105 | 12%,50/50 | 0.32% | 5 |
| INK G | 1500 | 43 | 70K/15K | 35,105 | 12%,50/50 | 0.22% | 5 |

D. Measurement of ink properties

1. Melt Viscosity

The melt viscosities in Table 8 were measured using a HAAKE VT 500 viscometer operated at a shear rate of 2155 $sec^{-1}$ and a temperature of 109° C.

2. Ink hardness/penetration

Grading of the normal oriented bar codes was performed at the same burn energies as for fine line. Again a 10X loupe was used to analyze the bars for voiding, blooming, and ticking. Scoring was based on a range 0–5, with 0 being the worst.

3. Print Quality of Rotated Bar Codes

A 10 mil Code 39 bar code was utilized to analyze the amount of trailing edge defect for each printing system. Burn energies were adjusted until an average bar growth of +/−0.03 was achieved. Average bar growth as measured with a verifier with a 6 mil aperture, a visible red light at 660 nanometers, and with a scanning accuracy of ten cycles. Trailing edge was then graded on a scale of 0–5, with 0 being the worst. Again a 10X loupe was used for the grading.

Also the rotated bars were evaluated for voiding. The same grading system was used based on the severity of the voiding. Voiding could be either fibers from the receiver showing through or from incomplete ink transfer.

4. Image Durability

Ink durability testing was performed using a A.A.T.C.C. Crockmeter at 250 cycles. A tip from a light wand verifier was the device used in the scratching of the printed image.

What is claimed is:

1. A thermal transfer ribbon comprising a support substrate, a release layer having a thickness of 0.1 to 1.0 micron provided on one side of the substrate and a pigmented layer provided on the release layer, wherein said release layer comprises an ethylene vinylacetate copolymer, an α-olefin maleic anhydride copolymer and wax and wherein the pigmented layer comprises a low structure carbon black, a polystyrene resin and a polyacrylate resin.

2. The thermal transfer ribbon of claim 1 wherein the amount of each of the ethylene vinylacetate copolymer and α-olefin maleic anhydride copolymer of the release layer is 5 to 15% by weight.

3. The thermal transfer ribbon of claim 2, wherein the amount of the ethylene vinylacetate copolymer is 11 to 13 percent by weight.

4. The thermal transfer ribbon of claim 3 wherein the amount of the α-olefin maleic anhydride copolymer is 10 to 13 percent by weight.

5. The thermal transfer ribbon of claim 2 wherein the ethylene vinylacetate copolymer contains between about 15 and 40 percent by weight of vinylacetate units.

6. The thermal transfer ribbon of claim 2 wherein the α-olefin of said α-olefin maleic anhydride copolymer has a chain length of $C_{10}$ to $C_{50}$.

7. The thermal transfer ribbon of claim 6 wherein the olefin:anhydride ratio of said α-olefin maleic anhydride copolymer is 1:1 to 1:4 in terms of weight.

8. The thermal transfer ribbon of claim 1 wherein the wax in said release layer is selected from the group consisting of microcrystalline wax, carnauba wax, petronaba wax, paraffin wax, candelilla wax and low molecular weight polyethylene.

9. The thermal transfer ribbon of claim 1 wherein the amount of wax in said release layer is 70 to 84 percent by weight.

10. The thermal transfer ribbon of claim 1 wherein the low structure carbon black of said pigmented layer has a dibutyl phthalate absorption value of 40 to 400 ml/100 g.

11. The thermal transfer ribbon of claim 10 wherein the oil absorption value is 40 to 50 ml/100 g.

12. The thermal transfer ribbon of claim 10 wherein the low structure carbon black has a particle size within the range of about 30 to 60 nm.

13. The thermal transfer ribbon of claim 10 wherein the amount of the low structure carbon black in said pigmented layer is between about 17 and 20 percent by weight.

14. The thermal transfer ribbon of claim 1 wherein the polystyrene resin of said pigmented layer has a Tg of from 40 to 110° C. and a $M_W$ of 1000 to 15000 g/mole.

15. The thermal transfer ribbon of claim 14 wherein said Tg is 40 to 70° C. and said $M_W$ is 1000 to 2000 g/mole.

16. The thermal transfer ribbon of claim 14 wherein the amount of polystyrene in said pigmented layer is in the range of about 23 to 28 percent.

17. The thermal transfer ribbon of claim 16 wherein said polystyrene resin is a copolymer of α-methylstyrene and either styrene or vinyltoluene.

18. The thermal transfer ribbon of claim 1 wherein the polyacrylate resin of said pigmented layer has a Tg within the range of 40 to 110° C. and an $M_W$ within the range of about 7000 to 300000 g/mole.

19. The thermal transfer ribbon of claim 18 wherein said Tg is 40 to 60° C. and said $M_W$ is 10000 to 50000 g/mole.

20. The thermal transfer ribbon of claim 18 wherein the amount of polyacrylate resin in said pigmented layer is within the range of from about 10 to 13 percent.

21. The thermal tranfer ribbon of claim 20 wherein said polyacrylate resin is a polymer of a methacrylate or a copolymer of a methacrylate with at least one of a methacrylic acid and an acrylamide.

22. The thermal transfer ribbon of claim 21 wherein said polyacrylate resin is a terpolymer of methylmethacrylate, methacrylic acid and N-butylmethacrylate having a range of methylmethacrylate in terms of mole percent of 30 to 80 percent.

23. The thermal transfer ribbon of claim 1 wherein a heat-resistant backcoat is provided on a side of the substrate opposite the side having the release layer and pigmented layer thereon.

24. The thermal transfer ribbon of claim 1 wherein said substrate is polyethylene terephthalate.

* * * * *